United States Patent [19]

Bert

[11] Patent Number: 4,949,433

[45] **Date of Patent: * Aug. 21, 1990**

[54] END CONNECTOR FOR EXPANSIBLE WATCH BAND

[75] Inventor: Stephen F. Bert, North Scituate, R.I.

[73] Assignee: Textron Inc., Providence, R.I.

[ * ] Notice: The portion of the term of this patent subsequent to Jun. 13, 2006 has been disclaimed.

[21] Appl. No.: 306,068

[22] Filed: Feb. 2, 1989

[51] Int. Cl.[5] ..... A44C 5/18

[52] U.S. Cl. ..... 24/265 WS; 24/265 B; 224/168

[58] Field of Search ..... 24/265 B, 265 WS; 59/79.1; 368/282; 224/175, 177, 167, 168, 179

[56] References Cited

U.S. PATENT DOCUMENTS

| | | | |
|---|---|---|---|
| 2,530,800 | 11/1950 | Augenstein | 24/265 WS X |
| 4,234,115 | 11/1980 | Williams | 224/168 |
| 4,805,271 | 2/1989 | Ripley | 24/265 WS |
| 4,837,901 | 6/1989 | Bert | 24/265 B |

FOREIGN PATENT DOCUMENTS

| | | | |
|---|---|---|---|
| 850972 | 10/1960 | United Kingdom | 59/79.1 |

*Primary Examiner*—James R. Brittain

*Attorney, Agent, or Firm*—Samuels, Gauthier & Stevens

[57] ABSTRACT

An end connector for connecting the ends of an expansible watch band to a watch case. The end connector is inserted between the endmost top and bottom links or the band and is engageable with the staples providing an interconnection therebetween.

4 Claims, 3 Drawing Sheets

END CONNECTOR FOR EXPANSIBLE WATCH BAND

BACKGROUND OF THE INVENTION

1. Field of the Invention

This invention relates generally to expansible bands, and is concerned in particular with an improved end connector for connecting the ends of such bands to watch cases or the like.

2. Description of the Prior Art

The conventional expansible watch band typically includes a row of top links overlying a row of bottom links, with each bottom link being connected to two adjacent top links by pairs of U-shaped staples. Springs housed in the links cooperate with the staples to yieldably contract the band.

A number of end connectors have been developed for use with such bands. For example, and as disclosed in copending application Ser. No. 164,093 filed on Mar. 4, 1988, now U.S. Pat. No. 4,805,271 an end connector has been provided with a flat shank received between the top and bottom links, the shank having a tab which is bent out of the plane of the shank and into an interengaged position protruding between two adjacent bottom links. The drawback with this arrangement is that the integrity of the connection depends to a large extent on the accuracy with which the tab is bent. Improper bending can produce a faulty connection, which in turn can result in loss of the watch and band.

Another type of end connector is disclosed in my copending application Ser. No. 185,920 filed on Apr. 25, 1988, now U.S. Pat. No. 4,837,901. This connector is again provided with a flat shank adapted to be received between the endmost top and bottom links of the band. The shank has contoured side edges which enable the connector to be manipulated in the plane of the shank into an interlocked position between the staples interconnecting the endmost top and bottom links. The drawback here, however, is that the connector can be disengaged by reverse manipulation of the shank. To prevent this from occurring, an additional element is employed to block reverse manipulation once the end connector is in place. Typically, the additional element comprises a cover which is snapped into place over the endmost top link. Because this cover member is exposed, its decorative appearance must match that of the band top links. Thus, each band requires its own specially configured end connector, a factor which complicates inventory tracking while contributing unnecessarily to manufacturing costs.

SUMMARY OF THE INVENTION

The objective of the present invention is to provide a still further improved end connector of the type having a generally planar shank adapted to be inserted between the endmost top and bottom links of the band. The shank has specially contoured side edges which accommodate manipulation of the connector in the plane of the shank into an interlocked position between the endmost pairs of staples. The same contoured side edges do not, however, permit the end connector to become disengaged by reverse manipulation of the shank. This advantage is achieved without employing additional specially configured and costly retainer elements.

DETAILED DESCRIPTION OF INVENTION

Figure 1:
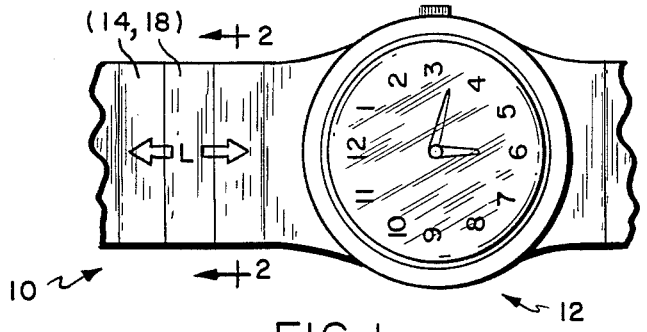
FIG. 1 is a partial top plan view of a watch band connected to a by means of an end connector in accordance with the present invention.
Figure 3:
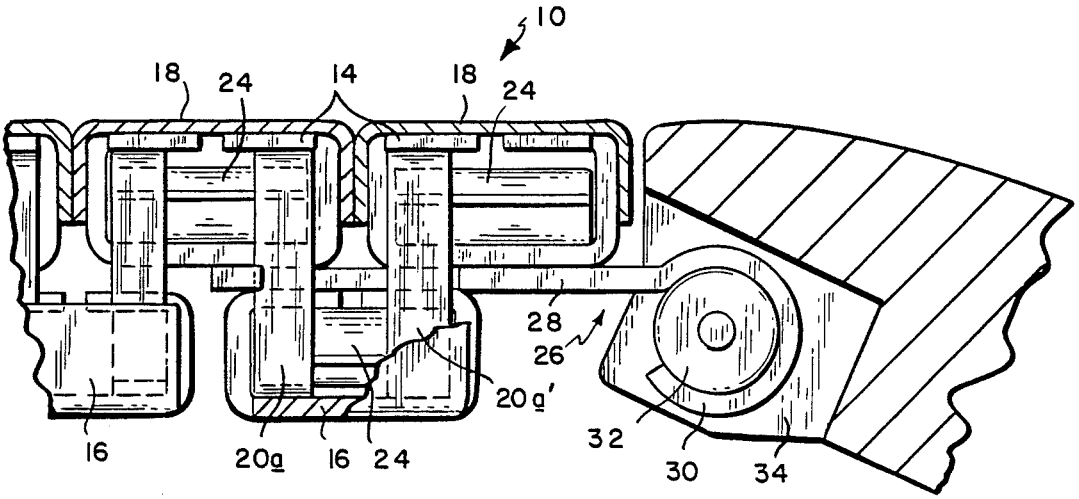
FIG. 3 is a sectional view, with portions broken away, taken along line 3—3 of FIG. 2.
Figure 2:
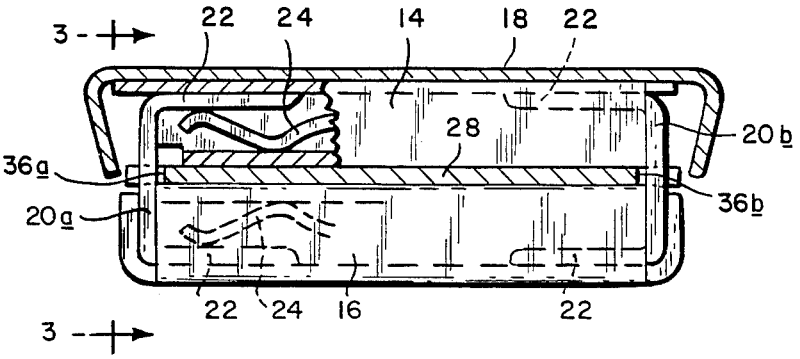
FIG. 2 is a cross elevational view, on an enlarged scale, taken along line 2—2 of FIG. 1.
Figure 5:
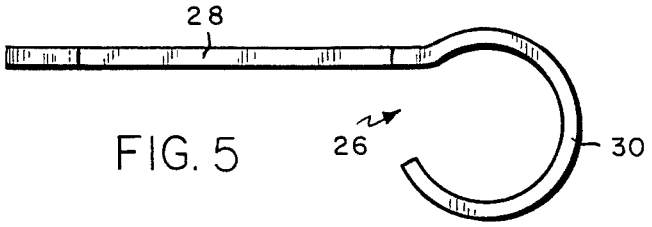
FIG. 5 is a side view of the end connector.

Referring initially to FIGS. 1–5, a conventional expansible watch band 10 is shown connected to a watch 12. The watch band has a row of top links 14 overlying a row of bottom links 16. The links have a somewhat box-like structure, with the top links 14 typically being covered by decorative top shells 18. Each bottom link 16 is connected to two adjacent top links 14 by first and second pairs **20*a*, 20*a*' and 20*b*, 20*b*' of U-shaped staples. As can be best seen in FIG. 4, the staple pairs are separated from each other by a first distance $d_1$ measured in the direction of the band width "W". The staples have legs 22 (FIG. 2) protruding into the ends of the links connected thereby. Leaf springs 24 are housed in the links. The springs 24 act on the staple legs 22** to yieldably contract the band in the direction of the band length "L", and to yieldably urge the staples of each pair apart and against the side walls of each link, to thereby occupy a maximum second distance $d_2$ measured in the direction "L".

The end connector of the present invention is generally indicated at 26 and comprises a generally planar shank 28 having its inner end received in an end of the band 10 between the rows of top and bottom links 14, 16, and having its outer end defined typically by a partially cylindrical hook 30 which protrudes beyond the end of the band. The hook 30 is configured to engage a spring bar 32 or the like extending between spaced lugs formed integrally with the watch case. One of the lugs is shown at 34 in FIG. 3.

First and second sides **36*a*, 36*b* extend between the inner and outer connector ends. First and second ears 38*a*, 38*b* respectively protrude laterally beyond the first and second sides 36*a*, 36*b* at the inner end of the shank. The width $w_1$ of the shank measured at the ears 36*a*, 36*b* is greater than the first distance $d_1$. The difference between the width $w_2$ of the shank measured between the sides 36*a*, 36*b* and the first distance $d_1$ is less than the distance $d_3$ that each ear 38*a*, 38*b*** protrudes beyond its respective side.

A notch 40 is located in the first side **36*a* between the inner and outer ends of the connector. The notch 40 is defined by inner and outer edges 42, 44 extending laterally from the first side 36*a* towards the second side 36*b*, and by a bottom edge 46** extending from the inner edge 42 to the outer edge 44. The distance $d_4$ measured between the inner and outer edges 42, 44 in the direction "L" is less than the distance $d_2$.

The diagonal distance $d_5$ across the notch 40 measured from the junction of the first side 36*a* and the inner edge 42 to the junction of the bottom edge 46 with the outer edge 44 is greater than the distance $d_2$. The length of the inner edge 42 is less than that of the outer edge 44, with the result that the junction of the bottom and outer edges defines an acute angle at the maximum depth of the notch 40. The width $w_3$ of the shank measured from the maximum depth of the notch 40 to a reference line extending in the direction L from the tip of ear 38*b* is less than the first distance $d_1$.

The manner of inserting and interlocking the end connector 26 into the end of the band 10 will now be described with reference to FIGS. 6–12. Beginning with FIG. 6, the end connector 26 is inserted into the end of the band in the direction of arrow "A" between the endmost top and bottom links in order to position the staple pair 20*a*, 20*a*′ within the notch 40, with the staple 20*a*′ being located at the maximum depth of the notch as defined by the junction of the bottom and outer edges 46, 44.

Figure 7:
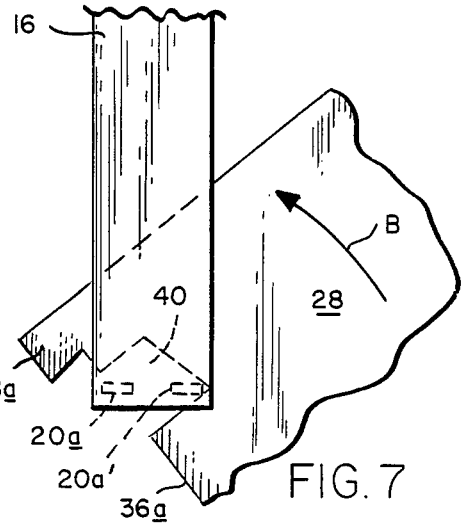
Figure 8:
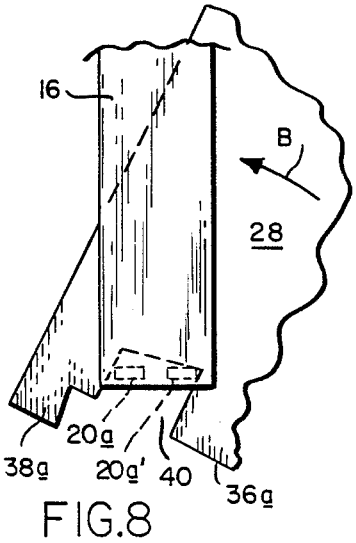
Figure 9:
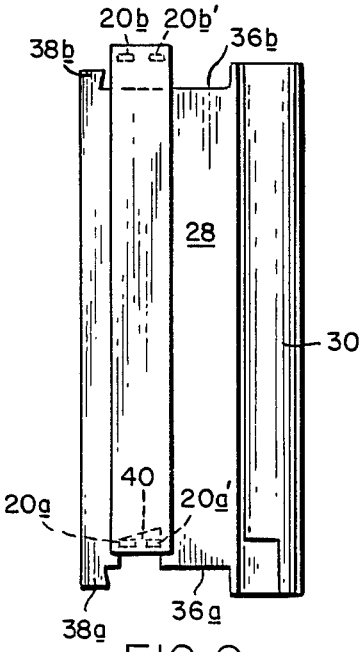
Figure 11:
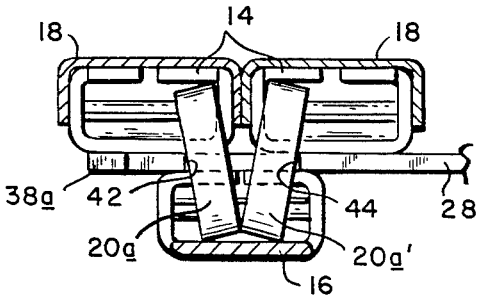
FIG. 11 is a side view looking in the direction of the arrows line 11—11 in FIG. 10.
Figure 10:
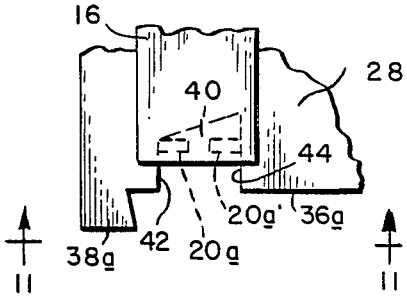
FIG. 10 is an enlarged view of a portion of FIG. 9.

As shown in FIG. 7, the end connector is then pivoted about staple 20*a*′ in the direction of arrow "B". As can be seen in FIG. 8, because the diagonal distance $d_5$ is greater than the distance $d_2$, the inner edge 42 moves in behind the staple 20*a*, with the result that the staples 20*a*, 20*a*′ are captured between the inner and outer notch edges 42, 44. As pivotal motion continues in the direction B, and because the distance $d_4$ is less than the distance $d_2$, the staples 20*a*, 20*a*′ are gradually urged towards one another against the resilient force acting on their respective legs 22 by the springs 24. Also because the width $w_3$ is less than distance $d_1$, the connector ear 38*b* moves in an arc within and past the staples 20*b*, 20*b*′. At the end of the pivotal motion in the direction B, as illustrated in FIGS. 9–11, the staples 20*a*, 20*a*′ are confined within the notch 40 between the inner and outer edges 42, 44, and the connector side 36*b* is spaced inwardly from the staples 20*b*, 20*b*′.

Figure 12:
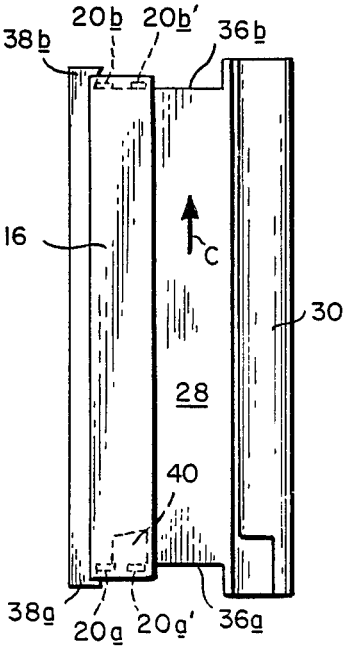
FIG. 12 is a schematic illustration of the final step required to shift the end connector into its interlocked position.

As illustrated in FIG. 12, the connector is then shifted laterally in the direction C, bringing the side 36*b* against or in close proximity to the staples 20*b*, 20*b*′, and thus allowing the staples 20*a*, 20*a*′ to escape from the confines of notch 40.

Figure 4:
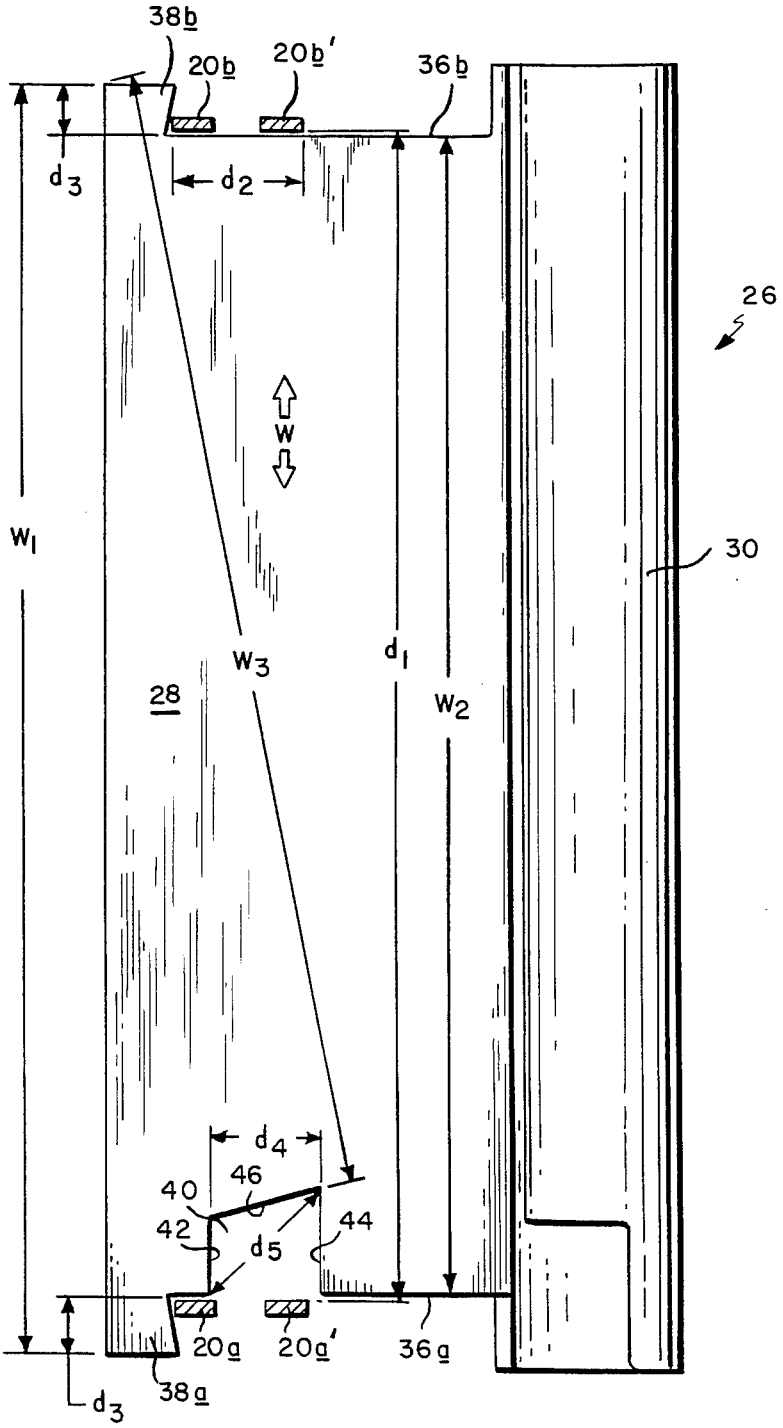
FIG. 4 is a greatly enlarged bottom view of the end connector of the, present invention illustrated in a fully interlocked position between the staple pairs interconnecting the endmost top and bottom links of the band.

When this happens, and as can best be seen in FIG. 4, the staples 20, 20*a*′ snap back under the resilient force of the springs 24 acting on their respective legs 22 to their original positions occupying distances $d_2$, which as previously mentioned, is greater than the distance $d_4$ measured between the inner and outer notch edges. Thus, the connector becomes captured between at least one of the staples 20*a*, 20*a*′ bearing on side 36*a*, and by both of the staples 20*b*, 20*b*′ bearing on the opposite side 36*b*. This effectively prevents any subsequent lateral shifting of the connector in a direction opposite to direction C, and thus results in the end connector being securely interlocked within the end of the band. This result is achieved without having to employ additional elements, such as covers or the like.

Figure 6:
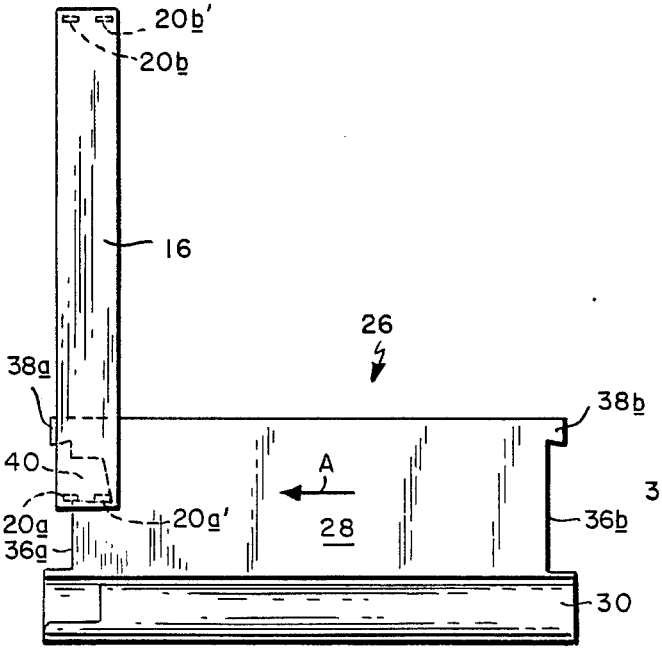
FIGS. 6–9 are schematic illustrations indicating sequential sters in the positioning of the end connector.

In the event that it becomes necessary to remove the end connector, e.g., as a preliminary step to removing one or more end links when shortening the length of the band, a tool (not shown) must be employed to squeeze the staples 20*a*, 20*a*′ together so that they can reenter the notch 40 as the connector is shifted laterally in a direction opposite to direction C. The sequence illustrated in FIGS. 6–8 is then reversed.

In the embodiment herein illustrated, the end connector is completely hidden from view from above. This is advantageous in that the same connector can be used with bands having different top shell designs. Of course, if desired, this advantage can be relinquished by having a portion of the end connector take the place of the endmost top link and shell.

I claim:

1. For use in combination with an elongated longitudinally expansible watch band of the type having a row of top links overlying a row of bottom links, each bottom link being connected to two adjacent top links by first and second pairs of generally U-shaped staples, said pairs of staples being separated from each other by a first distance measured in the direction of the band width and being arranged respectively along opposite sides of the band, said staples having legs protruding into the links connected thereby, with springs housed in the links and acting on said legs to yieldably contract the band longitudinally and to yieldably urge the legs of each staple pair apart to occupy a maximum second distance measured in the direction of the length of said band and defined by the spacing between the side walls of the links receiving said legs, a connector for connecting the band to a watch case, said connector comprising:

a generally planar shank having an inner end received in an end of the band between the rows of top and bottom links, an outer end protruding beyond the end of the band, and first and second sides extending between said inner and outer ends, said first and second sides being respectively located laterally inwardly of said first and second pairs of staples;

means at the outer end of said shank for connecting said shank to a watch case;

first and second ears respectively protruding laterally beyond said first and second sides at the inner end of said shank, said first and second ears being respectively located in the direction of the band length inwardly of the innermost staples of said first and second pairs, the width of said shank measured at said ears being greater than said first distance and the difference between the width of said shank measured between said first and second sides and said first distance being less than the distance that each of said ears protrudes beyond its respective side; and a notch in said first side edge, said notch being located between said inner and outer ends and being defined by inner and outer edges extending laterally from said first side towards said second side, and by a bottom edge extending from said inner edge to said outer edge, the distance measured between said inner and outer edges in the direction of the length of said band being less than said second distance.

2. The connector of claim 1 wherein the distance across a diagonal of said notch measured from the junction of said first side edge with said inner edge to the junction of said bottom edge with said outer edge is greater than said second distance.

3. The connector of claim 1 wherein the length of said inner edge is less than the length of said outer edge, and wherein the junction of said bottom and outer edges defines an acute angle at the maximum depth of said notch.

4. The connector of claim 3 wherein the width of said shank measured from the maximum depth of said notch to a reference line extending from the tip of said second ear and parallel to said second side edge is less than said first distance.

* * * * *